US010587982B2

(12) United States Patent
Fischer et al.

(10) Patent No.: US 10,587,982 B2
(45) Date of Patent: Mar. 10, 2020

(54) DUAL-ORIENTATION SPEAKER FOR RENDERING IMMERSIVE AUDIO CONTENT

(71) Applicant: DOLBY LABORATORIES LICENSING CORPORATION, San Francisco, CA (US)

(72) Inventors: David Matthew Fischer, San Francisco, CA (US); Warren Mansfield, Petaluma, CA (US); Adam Christopher Noel, Phoenix, AZ (US); Timothy James Eggerding, Oakland, CA (US); Philip Nicol, San Anselmo, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/060,372

(22) PCT Filed: Dec. 14, 2016

(86) PCT No.: PCT/US2016/066689
§ 371 (c)(1),
(2) Date: Jun. 7, 2018

(87) PCT Pub. No.: WO2017/106368
PCT Pub. Date: Jun. 22, 2017

(65) Prior Publication Data

US 2018/0367939 A1 Dec. 20, 2018

Related U.S. Application Data

(60) Provisional application No. 62/269,882, filed on Dec. 18, 2015.

(30) Foreign Application Priority Data

Apr. 22, 2016 (EP) ..... 16166654

(51) Int. Cl.
*H04R 5/02* (2006.01)
*H04S 7/00* (2006.01)
(Continued)

(52) U.S. Cl.
CPC ..... *H04S 7/305* (2013.01); *H04R 1/26* (2013.01); *H04R 1/323* (2013.01); *H04R 3/12* (2013.01);
(Continued)

(58) Field of Classification Search
CPC ..... H04R 1/02; H04R 1/025; H04R 1/026; H04R 2201/025; H04R 2205/024
(Continued)

(56) References Cited

U.S. PATENT DOCUMENTS 8,363,865 B1 1/2013 Bottum
8,934,647 B2 1/2015 Joyce
(Continued)

FOREIGN PATENT DOCUMENTS

CN 1312562 9/2001
CN 104904235 9/2015
(Continued)

*Primary Examiner* — George C Monikang

(57) ABSTRACT

Systems and methods are described for an adaptive audio system that renders reflected sound for adaptive audio systems in different ways depending on the orientation of at least one speaker in a set of speakers. A speaker of the system may comprise an integrated speaker having front-firing and upward-firing drivers, a sensor to determine the orientation of the speaker (e.g., horizontal or vertical) and a transceiver and control unit that transmits the orientation to a decoder and receives updated speaker feeds from the renderer based on the orientation.

15 Claims, 8 Drawing Sheets

(51) Int. Cl.

| | |
|---|---|
| ***H04R 1/26*** | (2006.01) |
| ***H04R 1/32*** | (2006.01) |
| ***H04R 3/12*** | (2006.01) |
| *H04S 3/00* | (2006.01) |

(52) U.S. Cl.
CPC ..... *H04R 5/02* (2013.01); *H04R 2205/024* (2013.01); *H04R 2420/01* (2013.01); *H04S 3/00* (2013.01)

(58) Field of Classification Search
USPC ..... 381/300, 304, 305
See application file for complete search history.

(56) References Cited

U.S. PATENT DOCUMENTS

| | | | |
|---|---|---|---|
| 8,965,014 | B2 | 2/2015 | Castor-Perry |
| 9,042,556 | B2 | 5/2015 | Kallai |
| 9,049,518 | B2 | 6/2015 | Freeman |
| 9,179,236 | B2 | 11/2015 | Robinson |
| 2006/0120541 | A1 | 6/2006 | Bhandare |
| 2011/0002487 | A1 | 1/2011 | Panther |
| 2013/0028446 | A1 | 1/2013 | Krzyzanowski |
| 2014/0233742 | A1 | 8/2014 | Giustina |
| 2014/0233771 | A1 | 8/2014 | Giustina |
| 2015/0016642 | A1 | 1/2015 | Walsh |
| 2015/0271620 | A1 | 9/2015 | Lando |
| 2018/0115733 | A1 | 4/2018 | Fischer |

FOREIGN PATENT DOCUMENTS

| | | |
|---|---|---|
| EP | 2104375 | 9/2009 |
| WO | 2014/035093 | 3/2014 |
| WO | 2014/107714 | 7/2014 |

DUAL-ORIENTATION SPEAKER FOR RENDERING IMMERSIVE AUDIO CONTENT

CROSS-REFERENCE TO RELATED APPLICATIONS

This application claims priority to U.S. Provisional Patent Application No. 62/269,882, filed on Dec. 18, 2015 and European Patent Application No. 16166654.0, filed on Apr. 22, 2015, each of which is incorporated herein by reference in its entirety.

FIELD OF THE INVENTION

One or more implementations relate generally to audio speakers, and more specifically to a flexible speaker configuration for dynamic rendering based on orientation of a multi-driver speaker.

BACKGROUND

Surround audio systems utilize an array of different speakers (also referred to as loudspeakers) that may include one or more drivers in a cabinet. A typical 5.1 or 7.1 surround sound (channel-based) system comprises five or seven speakers along with a subwoofer for low frequency effects (LFE). The speakers are designed and intended to be placed around a listening environment (e.g., room, theatre, auditorium, etc.) and play different channels of the audio program (e.g., front/back, left/right, etc.). The speakers may include different drivers to optimally play different frequencies, such as woofers for lower frequencies, mid-range speakers for mid frequencies, and tweeters for higher frequencies. Newer audio formats, such as the object-based Dolby Atmos system may introduce additional speakers, such as height speakers or reflected sound speakers that provide immersive sound by projecting sound based on height cues in the audio program.

In present channel-based systems, individual speakers are strictly assigned to specific channel feeds from a decoder or directly from the source and are meant to be placed at well-defined locations within the listening environment. Surround sound speakers are typically configured into sets of speaker types with relatively large single or dual-driver units for the side speakers, smaller speakers single-driver units for the front and back locations, a soundbar-type speaker for the central channel, and a large subwoofer for the LFE (.1) channel. Thus, present speaker systems for surround sound systems utilize a number of different speaker types, which are each required to be placed in a particular placement for optimal playback of the program content, which often requires special room configuration and installation routines.

The advent of object and immersive (or adaptive) audio in which channel-based audio is augmented with a spatial presentation of sound utilizes audio objects, which are audio signals with associated parametric descriptions of apparent position (e.g., 3D coordinates), apparent width, and other parameters. Such immersive audio content may be used for many multimedia applications, such as movies, video games, simulators, and can benefit from a flexible configuration and arrangement of speakers within the listening environment. A main advantage of immersive audio systems over traditional channel-based surround sound systems is the accurate representation of audio content around and above the listener as represented at least in part by height cues in the audio content. This however requires the use of specific (e.g., ceiling) speakers to project the height sound components from above a listener's head. Special speaker designs have been developed to allow relatively easy mounting in high locations, but this obviously adds a great deal of complexity and cost in laying out immersive audio speaker systems.

To take advantage of the immersive audio that is provided by the height component, but to not require physically mounted ceiling or high wall speakers, new speaker designs have been introduced that integrate upward-firing drivers to reflect sound off of an upper surface (e.g., ceiling) of a listening environment. This allows a floor standing or wall-mounted speaker to provide both direct and height projected sound into the listening environment. Such a speaker system is described in U.S. application Ser. No. 62/007,354 entitled "Audio Speakers Having Upward-firing Drivers for Reflected Sound Rendering," filed Jun. 3, 2014, which is hereby incorporated by reference in its entirety. This type of speaker can be used as the only speaker in a surround sound system as each speaker includes both direct (front) and upward-firing drivers, thus providing the side (L/R), front, back and center channel playback functions. Such a speaker is referred to herein as a "front/upward firing speaker" or an "integrated speaker." If appropriately configured with the proper driver or drivers, it can also function as a subwoofer capable of reproducing low-frequency effects (LFE). Thus, this type of speaker allows a surround sound system to use only one type of speaker, or at most two types, if a separate subwoofer is used.

One potential disadvantage of this type of speaker is its usage as the center channel speaker. A typical surround-sound speaker array uses a single central speaker for playback of primarily dialog content. Such a speaker is intended to be placed centrally and below a television monitor or cinema screen, and is usually packaged as a sound bar or long horizontal enclosure with a number of drivers, such as two to six drivers in a linear array. The integrated front/upward firing speaker is typically configured as a vertical speaker that features a tall profile relative to the base footprint. As such, it is not optimal for placement under a television or monitor. What is needed therefore, is a front/upward firing speaker that can be oriented either vertically or horizontally and transmit its orientation to an audio renderer or decoder and receive updated speaker feeds based on its orientation.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to a speaker system for use in immersive audio playback that minimizes the number of different types of speakers used and that allows for flexible arrangement of speakers within the listening environment. Such a system includes at least one speaker that can be placed in different orientations (e.g., vertically or horizontally), wirelessly transmit its orientation to a renderer or decoder, and receive updated speaker feeds based on its orientation. Embodiments include a speaker having a cabinet housing at least one upward-firing driver, and at least one front-firing driver, a sensor sensing an orientation of the cabinet, a wireless transmitter sending orientation information of the cabinet to an external renderer, and a wireless receiver configured to receive a first speaker feed when the cabinet is in a horizontal orientation and a second speaker feed when the cabinet is in a vertical orientation of the speaker. The first and second speaker feeds may be generated by an immersive audio renderer, and at least some of the second speaker feed may include audio signals having height cues. Each speaker feed may comprise one or more driver feeds each feeding a respective driver of the upward-firing driver and the front-firing driver. The driver feed for the upward-firing driver may have zero audio signal when the cabinet is in the horizontal orientation, whereas when the cabinet is in the vertical orientation the driver feed for the upward-firing driver may have an audio signal.

When the cabinet is in its vertical orientation, the at least one front-firing driver projects sound in a horizontal direction, while the at least one upward-firing driver projects sound upwards, i.e. at an angle with respect to the horizontal direction, for reflecting sound off of a ceiling during use. The angle is preferably an acute angle, e.g. between 20-60 degrees.

Embodiments are further directed to a speaker for playing immersive audio content in a room, having an enclosure having a vertical axis defining a speaker height and a horizontal axis defining a speaker width, an upward-firing driver within the enclosure configured to project sound having height cues to be reflected off of an upper surface of the room, a front-firing driver within the enclosure configured to project sound directly into the room, a sensor configured to sense an orientation of the enclosure on the floor of the room relative to the vertical axis and the horizontal axis, and a transceiver configured to transmit the orientation to a decoder and to receive appropriate speaker feeds from the decoder based on the orientation. The transceiver may be a wireless transceiver and the sensor may be an accelerometer, a gyroscopic component, or a level sensor. The immersive audio content may be channel-based audio and object-based audio including sound objects having height components.

Embodiments are also directed to a speaker for playing immersive audio content in a room, having a rectangular enclosure having a vertical dimension and a horizontal dimension, a plurality of drivers in the cabinet, including one or more drivers configured to project height cues present in the content, a sensor configured to sense an orientation of the enclosure on the floor of the room relative to the vertical dimension and the horizontal dimension; and a control circuit configured to modify an audio signal to the drivers based on the orientation of the enclosure. The speaker further has a transmitter configured to transmit the orientation to a renderer and a receiver configured to receive appropriate speaker feeds from the renderer based on the orientation. The modified audio signal transmitted to the drivers comprises the appropriate speaker feeds from the renderer, and the modification may comprise cutting respective driver feeds within the speaker feed to the one or more drivers projecting the height cues. The speaker may further have an upward-firing driver within the enclosure configured to project sound having the height cues to be reflected off of an upper surface of a room when the speaker is in a vertical orientation and one or more front-firing driver within the enclosure configured to project sound directly into the room.

Embodiments are yet further directed to methods of making and using or deploying the speakers, circuits, and transducer designs that optimize the rendering and playback of reflected sound content using a frequency transfer function that filters direct sound components from height sound components in an audio playback system.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
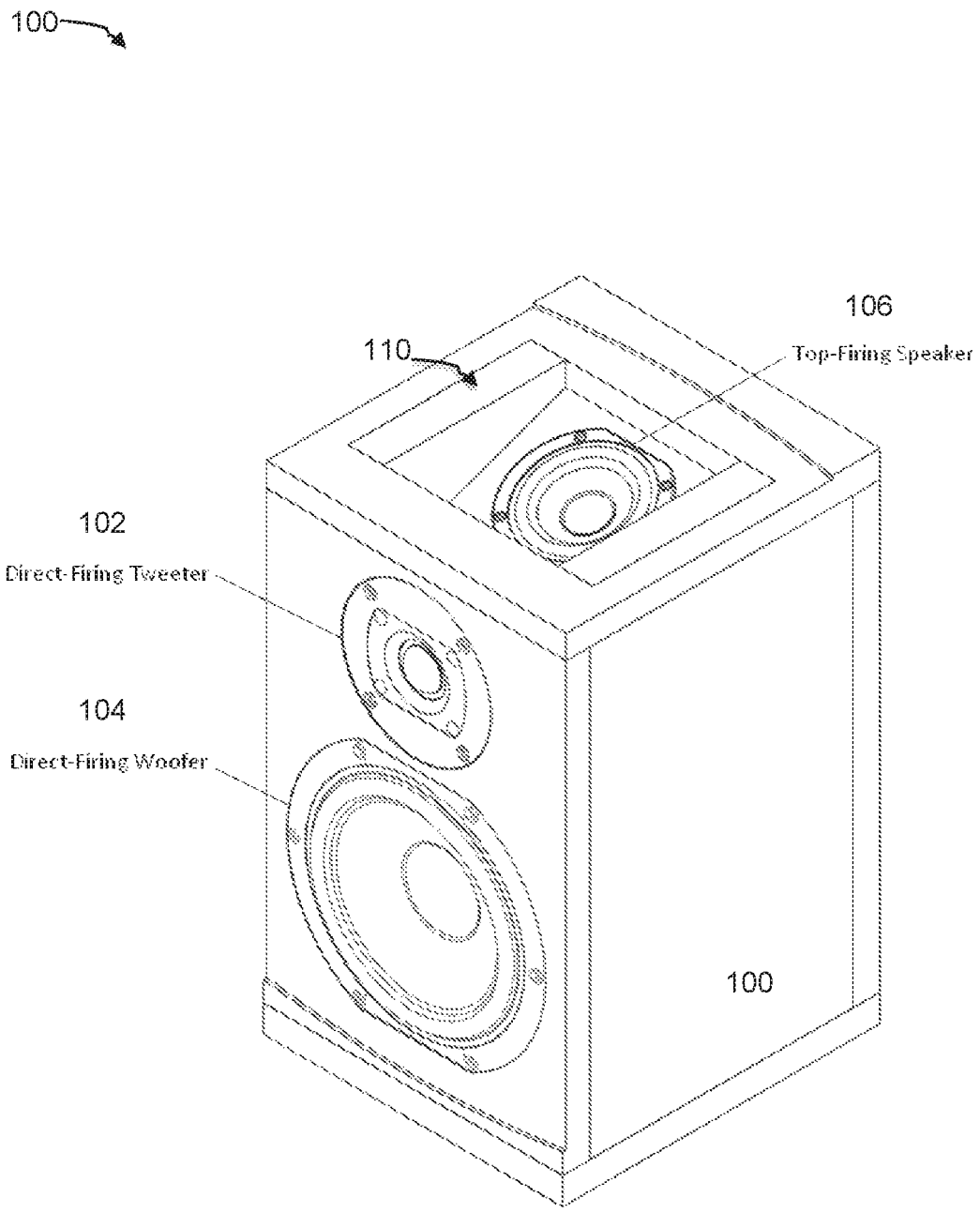
FIG. 1 illustrates an example integrated front/upward firing speaker that may be used in conjunction with certain embodiments.

Systems and methods are described for a dual-orientation speaker for use in adaptive audio system. The speaker can be oriented in one of a number of different orientations, such as vertically or horizontally. It transmits its orientation information to a renderer that transmits appropriate speaker feeds to the speaker based on its orientation. The speaker may comprise an integrated speaker having front-firing and upward-firing drivers, a sensor that determines the orientation of the speaker and a transceiver and control unit that transmits the orientation to a decoder/renderer and receives updated speaker feeds based on the orientation. An audio playback system can thus be configured to render reflected sound for adaptive audio systems in different ways depending on the orientation of at least one speaker in a set of speakers. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on (i.e., a collection of channels as just defined); the term "object" means one or more audio channels with a parametric source description, such as apparent source position (e.g., 3D coordinates), apparent source width, etc.; "object-based audio" means a collection of objects as just defined; and "immersive audio," "spatial audio," or "adaptive audio" means channel-based and object or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves. The term "driver" means a single electroacoustic transducer that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers. The terms "speaker feed" or "speaker feeds" may mean an audio signal sent from an audio renderer to a speaker for sound playback through one or more drivers, or it may mean different audio signals to be played back through different respective drivers in a single speaker with the speaker feed comprising separate "driver feeds."

Embodiments are directed to a reflected sound rendering system that is configured to work with a sound format and processing system that may be referred to as an "immersive audio system," "spatial audio system" or "adaptive audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio and object-based audio. Such a combined approach provides greater coding efficiency and rendering flexibility compared to either channel-based or object-based approaches taken separately. An example of an adaptive audio system that may be used in conjunction with present embodiments is described in U.S. Provisional Patent Application No. 61/636,429, filed on Apr. 20, 2012 and entitled "System and Method for Adaptive Audio Signal Generation, Coding and Rendering."

In general, audio objects can be considered as groups of sound elements that may be perceived to emanate from a particular physical location or locations in the listening environment. Such objects can be static (stationary) or dynamic (moving). Audio objects are controlled by metadata that defines the position of the sound at a given point in time, along with other functions. When objects are played back, they are rendered according to the positional metadata using the speakers that are present, rather than necessarily being output to a predefined channel. In an immersive audio decoder, the channels are sent directly to their associated speakers or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer utilizes certain algorithms to distribute the audio associated with each object across the attached set of speakers. The authored spatial intent of each object is thus optimally presented over the specific speaker configuration that is present in the listening environment.

An example implementation of an adaptive audio system and associated audio format is the Dolby® Atmos™ platform. Such a system incorporates a height (up/down) dimension that may be implemented as a 9.1 surround system, or similar surround sound configuration (e.g., 11.1, 13.1, 19.4, etc.). A 9.1 surround system may comprise composed five speakers in the floor plane and four speakers in the height plane. In general, these speakers may be used to produce sound that is designed to emanate from any position more or less accurately within the listening environment.

Though spatial audio (such as Atmos) may have been originally developed for movie programs played in cinema environments, it as been well adapted for home audio and smaller venue applications. Playing object-based audio in the home environment consists of audio signals being presented to the listener originating from in front of and around the listening position in the horizontal plane (main speakers) and overhead plane (height speakers). A full home enabled loudspeaker system layout will typically consist of: front loudspeakers (e.g., Left, Center, Right, and optionally Left Center Right Center, Left Screen, Right Screen, Left Wide, and Right Wide), Surround loudspeakers (e.g.,: Left Surround, Right Surround, and optionally Left Surround 1, Right Surround 1, Left Surround 2, Right Surround 2), surround back loudspeakers (e.g., Left Rear Surround, Right Rear Surround, Center Surround, and optionally Left Rear Surround 1, Right Rear Surround 1, Left Rear Surround 2, Right Rear Surround 2, Left Center Surround, Right Center Surround), height loudspeakers (e.g., Left Front Height, Right Front Height, Left Top Front, Right Top Front, Left Top Middle, Right Top Middle, Left Top Rear, Right Top Rear, Left Rear Height, Right Rear Height), and subwoofer speakers. Different nomenclature and terminology may be used to distinguish the speakers in the defined array. Loudspeakers come in various types as follows: a) in-room (traditional box speakers on a stand or in a cabinet); b) in-wall (traditionally mounted in the wall in the horizontal plane around the listener); c) on-wall (traditionally mounted on the wall in the horizontal plane around the listener); d) in-ceiling (traditionally mounted in the ceiling above the listener for the surrounds and far forward for the fronts); and e) on-ceiling (traditionally mounted on the ceiling above the listener for the surrounds and far forward for the fronts).

Dual-Orientation Speaker System

In one embodiment, a multi-driver speaker has been developed that combines front-firing driver(s) with upward-firing driver(s). The upward-firing driver projects sound to an upper surface of the listening environment where it is reflected back down to the listener. This provides the height components of the immersive sound and eliminates the need for height speakers to be mounted on the ceiling or high wall areas. FIG. 1 illustrates an example integrated front/upward firing speaker that may be used in conjunction with certain embodiments. As shown in FIG. 1, speaker cabinet 100 includes two forward firing drivers 102 and 104 and an upward-firing driver 106. The upward-firing driver 106 is configured (with respect to location and inclination angle) to send its sound wave up to a particular point on the ceiling where it reflected back down to a listening position. It is assumed that the ceiling is made of an appropriate material and composition to adequately reflect sound down into the listening environment. The relevant characteristics of the upward-firing driver (e.g., size, power, location, etc.) may be selected based on the ceiling composition, room size, and other relevant characteristics of the listening environment. The front (or direct) firing drivers are shown as a woofer 104 and a tweeter 102, but any appropriate driver or set of drivers can be used, such as midrange drivers, or combinations of different drivers. Likewise, although only one upward-firing driver is shown, multiple upward-firing drivers may be incorporated into a reproduction system in some embodiments. For the embodiment of FIG. 1, it should be noted that the drivers may be of any appropriate, shape, size and type depending on the frequency response characteristics required, as well as any other relevant constraints, such as size, power rating, component cost, and so on.

FIG. 1 illustrates the use of an upward-firing driver using reflected sound to simulate one or more overhead speakers and wherein the sound produced by receiving a rendered speaker feed sent to the upward-firing driver 106. The upward-firing driver is generally positioned such that it projects sound at an angle up to the ceiling where it can then bounce back down to a listener. The angle of tilt may be set depending on listening environment characteristics and system requirements. For example, the upward-firing driver 106 may be tilted up between 20 and 60 degrees and may be positioned above the front-firing drivers in the speaker enclosure 108 so as to minimize interference with the sound waves produced from the front-firing drivers. The upward-firing driver 106 may be installed at a fixed angle, or it may be installed such that the tilt angle may be adjusted manually. Alternatively, a servo mechanism may be used to allow automatic or electrical control of the tilt angle and projection direction of the upward-firing driver. The upward-firing driver 106 may be installed within an angled portion of the cabinet 108 and that may include certain acoustic elements, such as baffles or acoustic guards 110. Alternatively, it may be provided as a separate cabinet that is attached to the front driver cabinet.

Figure 2:
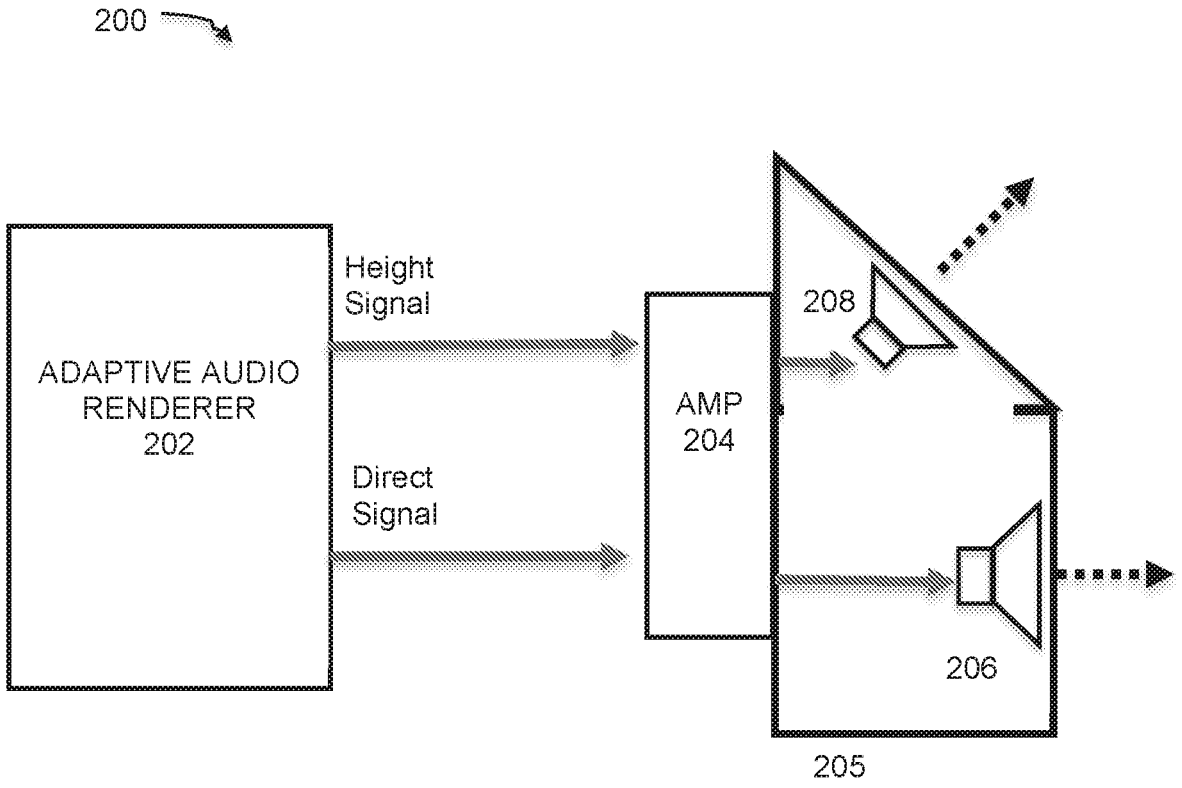
FIG. 2 illustrates the speaker feeds for an integrated front/upward firing speaker, under some embodiments.

In an embodiment, the integrated front/upward firing speaker receives two speaker feeds from an audio renderer. One speaker feed is used to drive the front-firing speaker driver or drivers (for example, the Left speaker feed), and the other speaker feed is used to drive the upward-firing speaker driver (for example, the Left Top Middle speaker feed). FIG. 2 illustrates the speaker feeds for an integrated speaker, under some embodiments. As shown in diagram 200 an adaptive audio renderer 202 outputs speaker feeds to drive individual drivers of an array of speakers. The speaker feeds may comprise direct signals to be played through the front-firing driver or drivers 206 of speaker 205, and a height signal to be played through the upward-firing driver 208 of the speaker. The speaker feeds may be transmitted through one or more amplifier 204 stages or other signal processing stages prior to transmission to the speaker drivers. The amplifier 204 may be provided as a separate component between the renderer and the speakers or it may be provided as a circuit within an AVR or other component that includes the renderer. Alternatively, the amp may be integrated in the speaker itself, such as in a powered speaker or wireless speaker.

In an embodiment, the integrated speaker comprises a wired or wireless powered speaker in which an amplifier is integrated with the speaker and provides power to drive the speakers and the orientation detection circuit and transmitter, as well as the on-board microphone and any other ancillary circuits. In an alternative embodiment, the integrated speaker comprises a passive wired speaker that does not include an on-board amplifier. A separate integrated power supply, such as a battery or small power adapter may be provided to power the orientation detection and transmitter circuitry.

In an embodiment, speaker 205 is an integrated speaker that is configured to operation in a normal mode in which it is oriented vertically with respect to the position of the upward-firing driver above the front-firing driver. In this orientation, both drivers operate normally to playback the content sent by the renderer over the individual speaker feeds. In some cases, the renderer may not send height signals or direct signals, but both drivers or sets of drivers are available to provide playback. In one embodiment, all of the speakers used in a surround sound system may comprise identical speakers 205 that have both upward and front-firing drivers. In such a system, different types of speakers do not need to be used, and the height signals can be recreated by any of the speakers without requiring any separate ceiling or height mounted speakers.

Figure 3:
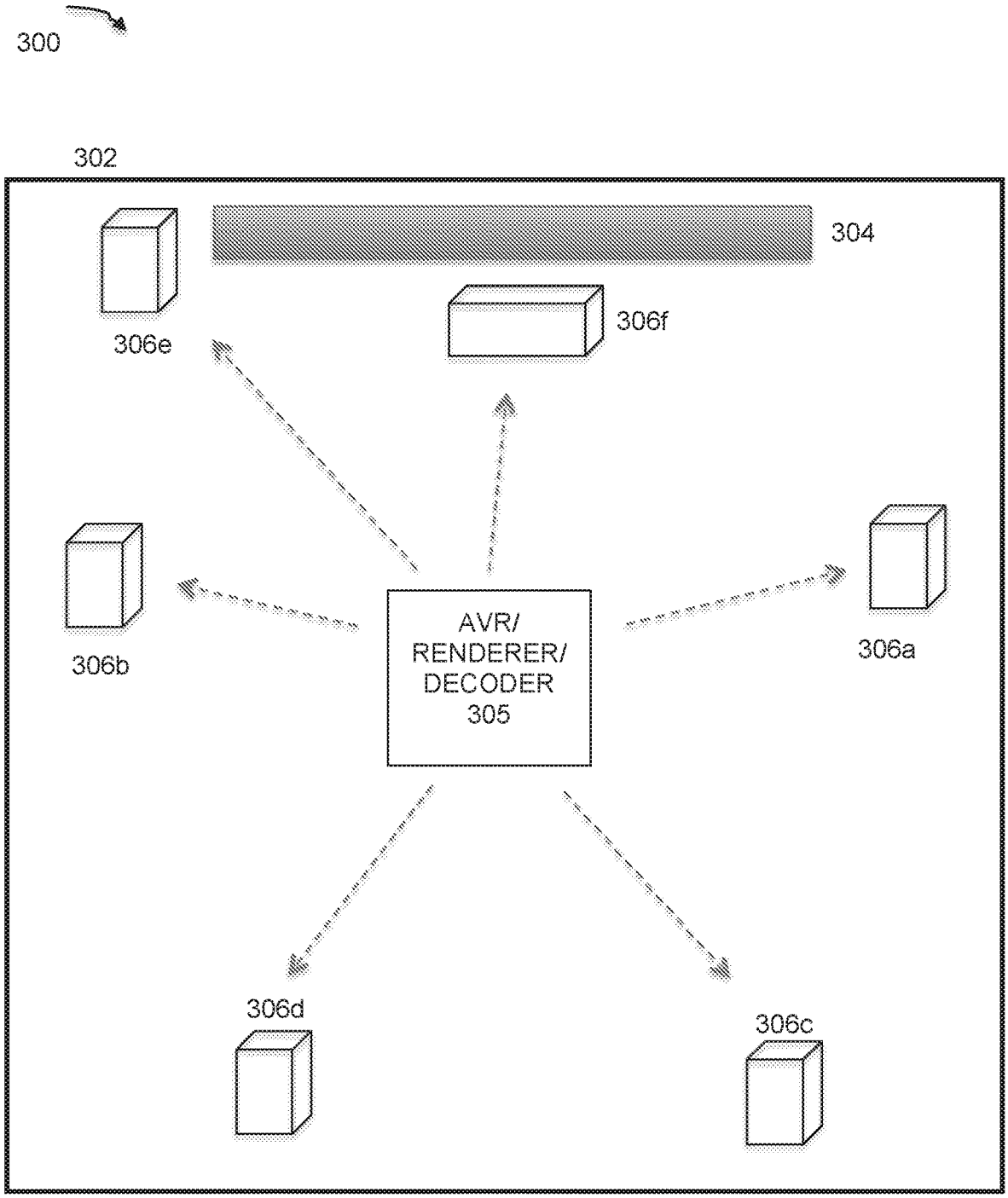
FIG. 3 is a top view of a listening environment with a number of integrated front/upward-firing drivers used with an immersive audio renderer, under some embodiments.

FIG. 3 is a top view of a listening environment with a number of integrated front/upward-firing drivers used with an immersive audio renderer, under some embodiments. As shown in FIG. 3, a listening environment (room) has an A/V monitor (e.g., television, projection screen, theatre screen, game console display, etc.) 304 and a number of speakers arranged around the room. An AVR/renderer 305 transmits audio signals in the form of speaker feeds to each of the speakers. Component 305 generally represents an immersive audio component that is generally referred to as a "renderer." Such a renderer may include or be coupled to a codec decoder that receives audio signals from a source, decodes the signals and transmits them to an output stage that generates speaker feeds to be transmitted to individual speakers in the room. As stated previously, in an immersive audio system, the channels are sent directly to their associated speakers or down-mixed to an existing speaker set, and audio objects are rendered by the decoder in a flexible manner. Thus, the rendering function may include aspects of audio decoding, and unless stated otherwise, the terms "renderer" and "decoder" may both be used to refer to an immersive audio renderer/decoder 305, such as shown in FIG. 3, and in general, the term "renderer" refers to a component that transmits speaker feeds to the speakers, which may or may not have been decoded upstream.

In an embodiment, each of the speakers 306 is embodied in an integrated front/upward firing speaker, such as speaker 205 shown in FIG. 2. The speakers 306 are identical to one another but receive different speaker feeds from the renderer 305 based on their location within the room and orientation.

As shown in FIG. 3, the speakers 306 are arranged in a nominal 5.1 surround sound arrangement so that speakers 306*a* and 306*b* are the L/R side channel speakers, 306*c* and 306*d* are the L/R surround channel speakers, 306*e* is the subwoofer speaker and 306*f* is the center channel speaker. It should be noted that the arrangement of speakers 306 in FIG. 3 is intended to be an example, and any other number and arrangement of speakers is also possible, such as a 7.1, 9.1, 9.2 or similar layout. The subwoofer speaker 306*e* may be embodied as the same type of integrated speaker as the other speakers 306*a-d*, or it may be embodied as a separate dedicated subwoofer speaker.

As shown in diagram 300, a room containing a monitor 304 has a set of speakers 306 arranged roughly in a surround sound configuration. In general, a "speaker array" is a set of speakers with specific location assignments, such as corresponding to established surround sound placement guidelines. For purposes of description a "set of speakers" refers to speakers placed in a listening environment with no strict location assignments, but that may correspond at least roughly to a surround sound arrangement.

In an embodiment, the AVR or renderer/decoder 305 of FIG. 3 comprises an audio/video receiver for use in home entertainment environments (home theater, home television, etc.). The AVR generally performs three functions. First, it provides a connection point for multiple source devices, and the AVR is responsible for switching among the inputs. Second, it performs amplification for speakers. Third, it performs audio decoding and processing (e.g., surround sound processing, Dolby Pro Logic™ processing, Dolby Digital™ processing, Dolby TrueHD™ processing, etc.).

The AVR 305 may be coupled to the speakers via a wireless link, though a direct wired connection may also be used for an integrated speaker that has on-board power for the orientation circuitry. Thus, each speaker is typically a wireless speaker having upward and front-firing drivers and an amplifier stage, and a wireless receiver. In general, wireless speakers receive the input audio signal wirelessly, instead of receiving an electrical audio signal via a wire. The wireless speakers may connect to the AVR 305 or audio source via a Bluetooth™ connection, a WiFi™ connection, or proprietary connections (e.g., using other radio frequency transmissions), which may (or may not) be based on WiFi™ standards or other standards. In an embodiment, the AVR 305 may be embodied as an HDMI media stick that replaces traditional AVR boxes and wiring, and that communicates wirelessly with the speakers. Embodiments of the speakers thus work in conjunction with a Media stick such as described in co-pending Provisional Patent Application No. 62/133,004 entitled "Media Stick for Controlling Wireless Speakers," filed on Mar. 3, 2015, and which is hereby incorporated in its entirety.

As described in the above-reference patent application, certain side chain information is transmitted between the speaker(s) and renderer including discoverable data regarding speaker location, type, and so on. Embodiments described herein add certain data elements to this information including initial orientation (e.g., vertical vs. horizontal) and any updated information such as change in location or orientation or configuration (i.e., manual cutout or addition of drivers).

For the embodiment shown in FIG. 3, the center channel speaker 306*f* is shown in a different orientation to the other speakers. As stated earlier, the surround speakers are typically placed in a vertical orientation so that the upward-firing driver is above the front-firing drivers, which themselves are aligned vertically off of the floor. Such speakers may be thought of as column speakers, tower speakers, or the like. The center channel speaker 306*f* is usually not embodied as a vertical tower speaker, but rather as a horizontal driver array or soundbar since it is usually placed near or below the monitor 304. In this case, a vertical orientation for the integrated speaker will not work optimally and a different speaker configuration is required. In an embodiment, the integrated speaker 205 is configured to be a dual-orientation speaker that can function in both a vertical orientation and a horizontal orientation, and transmit the appropriate speaker feeds through the proper drivers depending on the orientation. Thus a first set of speaker feeds may be sent to speaker 306*f* if it is in a vertical direction (e.g., functioning as a side speaker), while a different set of speaker feeds may be sent to speaker 306*f* if it is in a horizontal orientation (e.g., functioning as a center channel speaker). Moreover, the one or more of the drivers in the speaker may effectively be cut out depending on its orientation and functionality, such as if a zero signal driver feed is sent to the speaker for a particular driver.

The AVR 305 communicates wirelessly with the speakers 306*a-f*. The bandwidth available for wireless communication is limited. Moreover, interference may occur between different wireless appliances, e.g. in the 2.4 GHz or 5 GHz band. When the AVR 305 receives information indicating that speaker 306*f* is in the horizontal orientation, the AVR 305 wirelessly transmits a speaker feed to speaker 306*f* which does not include a driver feed for the upward-firing driver, i.e. the speaker feed need only include a driver feed for the other drivers of the speaker 306*f*. Therefore, less data has to be sent to speaker 306*f* and the system 300 therefore reduces bandwidth usage.

AVR 305 may determine that the speaker 306*f* is to be operated as a front central speaker upon receiving the information indicating that speaker 306*f* is in the horizontal orientation. The AVR 305 may be configured to send a speaker feed to speaker 306*f* corresponding to the speaker feed of a front central speaker when the information indicates that the speaker 306*f* is in the horizontal orientation. Alternatively or additionally, in a speaker discovery process, the renderer may set the speaker which is in the horizontal orientation as the front central speaker and may use said speaker as a reference for the other speakers during the discovery process.

Figure 4:
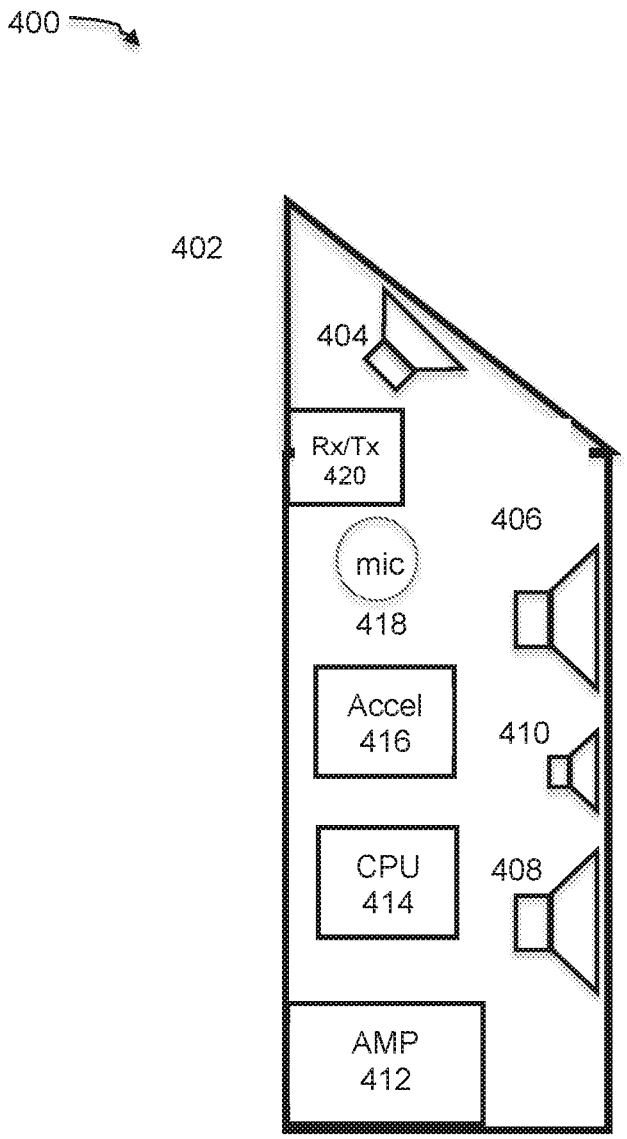
FIG. 4 illustrates components of a dual-orientation integrated front/upward firing speaker for use in an immersive audio system, under some embodiments.

In an embodiment, the speaker is configurable to act as an integrated upward/direct speaker when oriented vertically, or a bipole or single driver speaker when placed on its side or horizontally. FIG. 4 illustrates components of a dual-orientation integrated front/upward firing speaker for use in an immersive audio system, under some embodiments. Speaker 402 includes an upward-firing driver 404 and a number of front (or direct) firing drivers 406, 408, and 410. Any number and type of drivers may be used depending on system requirements and constraints. For the example of FIG. 4, two midrange or woofer drivers 406 and 408 are provided along with a tweeter or similar high frequency driver 410. This allows the speaker to operate in bipole mode wherein a combination of at least one woofer 406 and/or 408 along with the tweeter 410 allows the speaker to playback a relatively full range of frequencies. In a wireless rendering system, the speaker 402 includes an internal amplifier 412 and a transceiver 420 for receiving the speaker feeds from the renderer, and optionally transmitting certain operating conditions of the speaker back to the renderer.

In an embodiment, the speaker 402 includes an accelerometer, gyroscope, level sensor, or similar component 416 that is capable of determining the orientation of speaker 402 relative to the ground. In general, the cabinet of the speaker 402 allows for the speaker to act as a dual-orientation speaker that can be placed vertically (as shown) such that the drivers are vertically in line with respect to the ground, or horizontally, such that the drivers are horizontally in line with respect to the ground. A microcontroller or similar component can be used to interface between the accelerometer (or equivalent) and the communications interface (e.g., WiFi link).

Figure 5A:
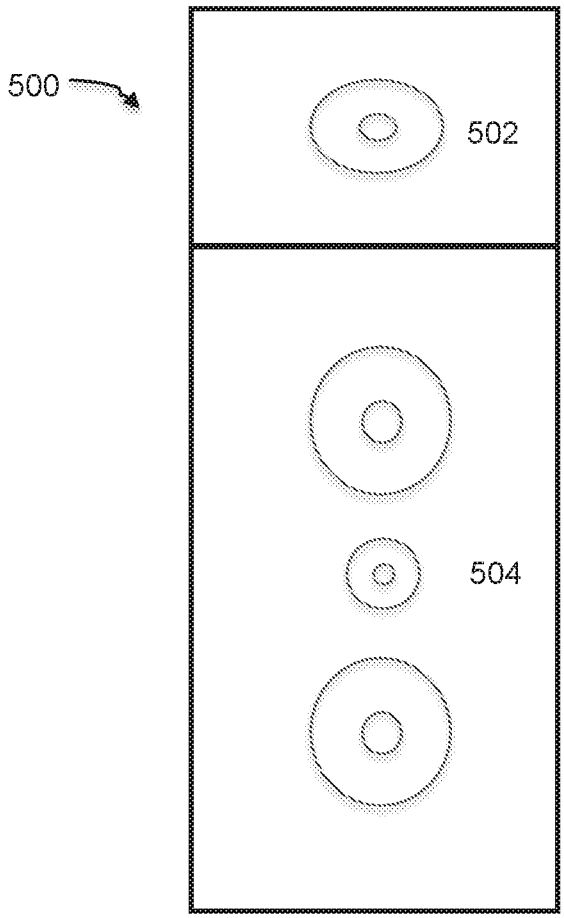
FIG. 5A illustrates a dual-orientation enabled speaker placed in a vertical orientation, under an embodiment.
Figure 5B:
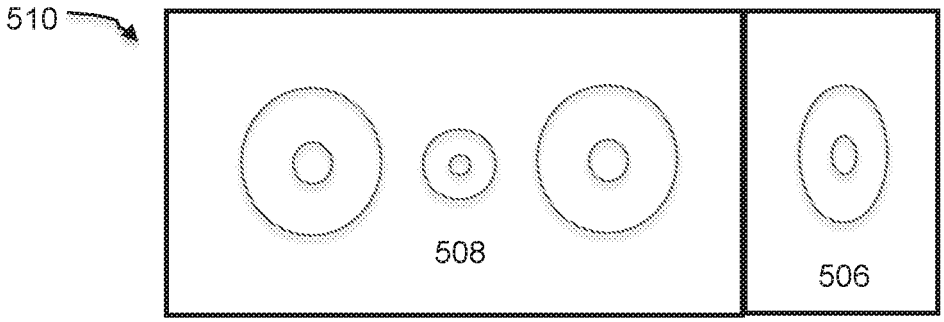
FIG. 5B illustrates a dual-orientation enabled speaker placed in a horizontal orientation, under an embodiment.

FIG. 5A illustrates speaker 402 placed in a vertical orientation, and FIG. 5B illustrates speaker 402 placed in a horizontal orientation. In the vertical orientation 500 upward-firing driver 502 projects sound upward to be reflected off of the ceiling or wall, while front-firing drivers 504 project sound out of the front of the cabinet. In the horizontal orientation 510, the speaker is configured to operate in bipole mode so that only the front-firing drivers 508 operate, or any one or a pair of front-firing drivers. In this case, the upward-firing driver 506 (which now projects at a sideward angle) may be effectively turned off by receiving no signal through the speaker feed. Other operational configurations may also be implemented when operating in the horizontal orientation. For example, to ensure that the desired directivity and response in both vertical and horizontal orientations is achieved, additional tweeters can be added and only activated when the speaker is in the bipole orientation. Likewise, various drivers or driver sections may be activated or deactivated in each orientation through appropriate switches or other control means based on the input of the accelerometer 416.

The orientation of the speaker is transmitted to the renderer so that the renderer can send appropriate signal feeds to the speaker depending on the orientation. For example, when in the horizontal orientation, the upward-firing driver may not be needed as no height signals can effectively be projected when it is horizontal, so the speaker feed either includes no signal for the upward-firing driver, or it is otherwise cut out of the signal chain, such as through a manual on/off switch, or a switch automatically activated by the accelerometer. Furthermore, in the horizontal orientation, only certain content may be effectively played back due to the orientation of the speaker. For example, the horizontal speaker may be functioning as a center channel speaker and so receive primarily dialog or voice content, but which may also include some music, effects, or other content. Thus, the orientation of the speaker dictates which of the drivers are active or inactive, and the speaker feeds that are sent from the renderer to the speaker. Regardless of the content mix, once the orientation of the speaker has been transmitted back to the renderer/decoder, it receives the appropriate speaker feeds intended for the speaker given its position and orientation.

Figure 6A:
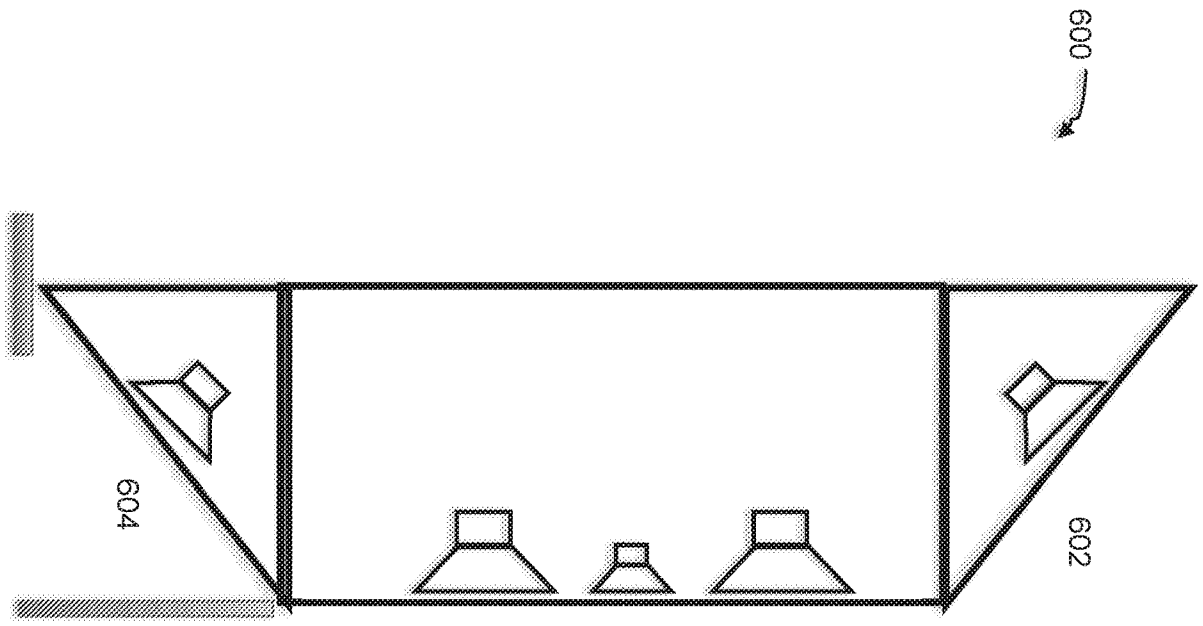
FIG. 6A is a side-view illustration of a dual-orientation speaker including both upward and downward firing drivers and in a vertical orientation, under an embodiment.
Figure 6B:
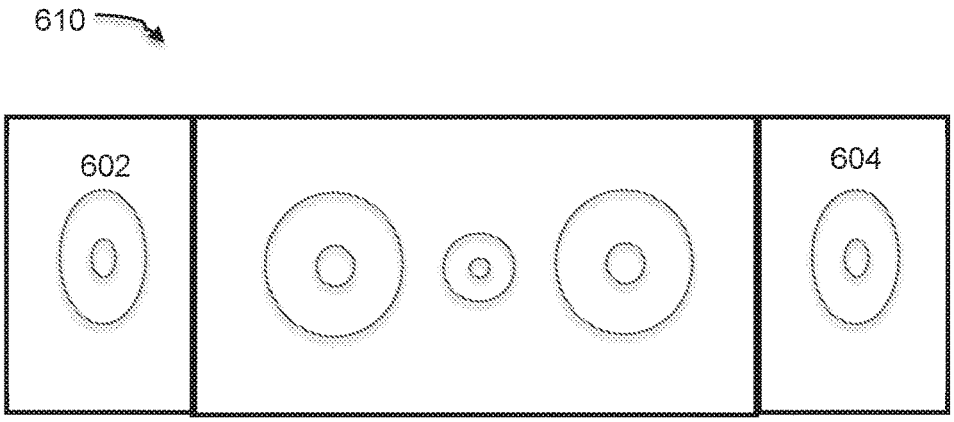
FIG. 6B is a front-view illustration of the dual-orientation speaker of FIG. 5A in a horizontal orientation.

In an alternate embodiment, the dual-orientation speaker may include a downward-firing driver in addition to the upward-firing driver. Such a driver may be a subwoofer driver that is included to provide extended bass or low-frequency effects in the same cabinet as the upward and front-firing drivers, or it may be a driver that is provided to render downward-reflected (depth or low height) audio components. FIG. 6A is a side-view illustration of a dual-orientation speaker including both upward and downward-firing drivers and in a vertical orientation 600, under an embodiment; and FIG. 6B is a front-view illustration of the dual-orientation speaker of FIG. 6A in a horizontal orientation 610. The upward-firing driver 602 and the downward-firing driver 604 essentially become left and right angled side-firing drivers when the speaker is placed horizontally 610. In this orientation, both of the drivers 602 and 604 can be switched off and deactivated, or they could be activated to operate in a sideways reflection orientation in which the signal sent to these speakers is reflected off of a near wall. The renderer can be configured to transmit special speaker feed signals to these sideways reflection speakers, such as LFE or ambient sounds.

In an embodiment, speaker 402 may also include a microphone 418 (e.g., a capsule microphone or similar device) that allows captured audio from the playback environment to be sent to the source audio renderer so that unique signal processing may be applied to calibrate playback to the listening environment. The speaker may also include a processor (CPU) 414 and transceiver to allow speaker to transmit certain configuration information, such as speaker orientation, speaker type, driver configuration, calibration, and other configuration information to the renderer for initial setup and dynamic (during program) rendering. The CPU 414 can also perform other processing functions, such as height cue filter implemented in DSP circuits (rather than through passive filters). Embodiments of a height cue filter that may be implemented in a speaker, such as speaker 402 are described in U.S. Patent Application Ser. No. 62/163,502 entitled "Passive and Active Virtual Height Filter Systems for Upward-firing Speakers," filed on May 19, 2015, and which is hereby incorporated by reference in its entirety. Such a filter can be turned off if the speaker is moved to a different orientation. Similarly, other functions may also be included in speaker 402, such as a decorrelation filter that may be applied to the split speaker feed. Self-calibration operations may also be performed by each speaker using the microphone 418.

Figure 7:
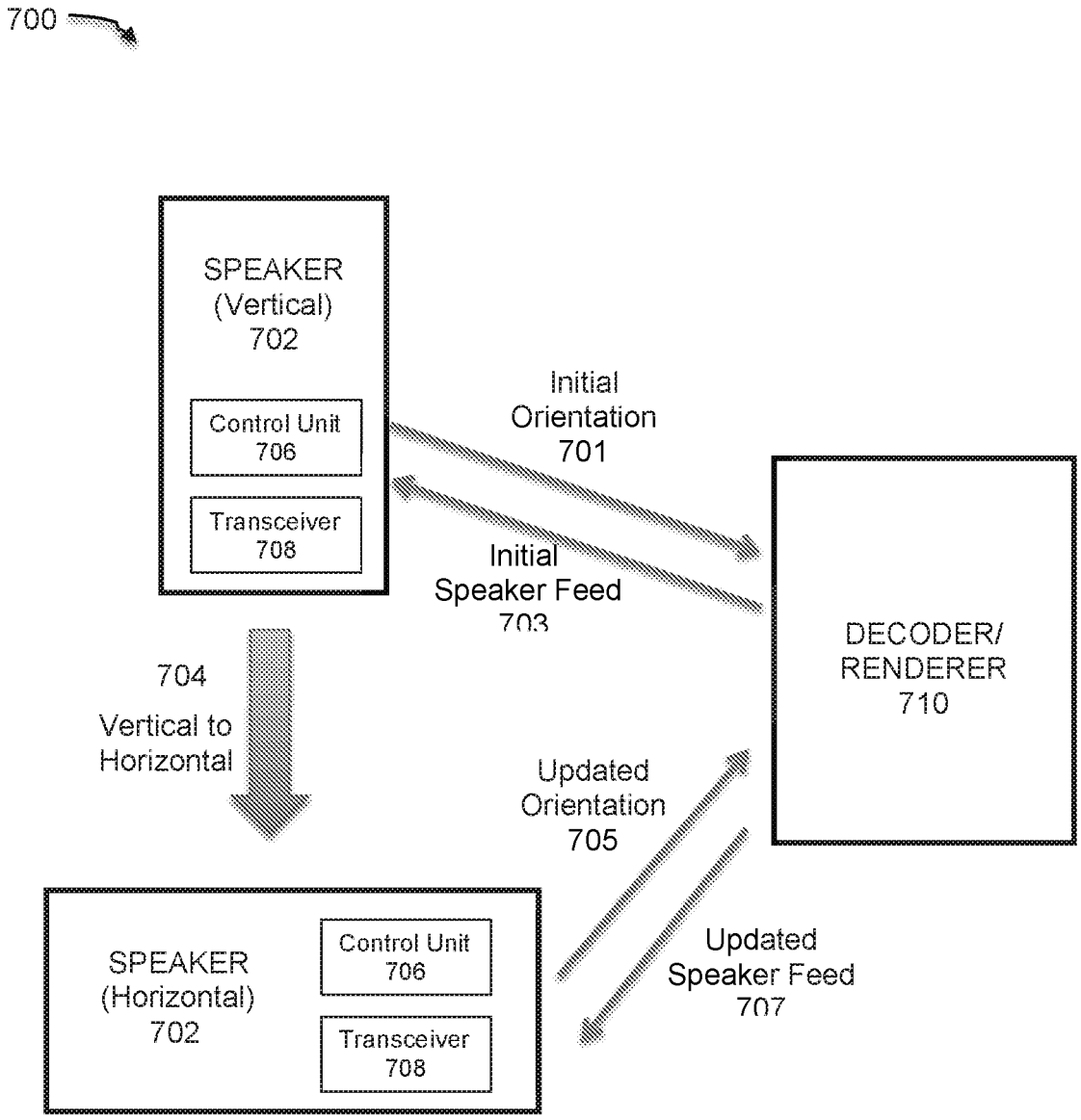
FIG. 7 is a block diagram illustrating communication between a dual-orientation speaker and a renderer/decoder, under some embodiments.

In embodiment, the orientation of the speaker determines what speaker feeds it receives from the renderer. FIG. 7 is a block diagram illustrating communication between a dual-orientation speaker and a renderer/decoder, under some embodiments. As shown in diagram 700, a speaker 702 is moved from a vertical orientation to a horizontal orientation through a placement operation 704. A control unit 706 inside the speaker includes circuitry to detect the change in orientation, and a transceiver 708 transmits this information 701 to the decoder/renderer 710. When the speaker is in a first or initial orientation 701, it transmits this information to the renderer 710 which then transmits an initial speaker feed 703 based on this orientation. After the speaker is moved to a different or updated orientation 705, the renderer receives this update and transmits updated speaker feeds 707 back to the speaker. These updated speaker feeds provide the appropriate signals to for the speaker drivers based on the changed orientation 704. If the speaker is placed back in the vertical orientation from the horizontal orientation, the initial speaker feed 703 may be sent back to the speaker, or a different speaker feed may be sent from renderer 710.

The initial orientation 701 may be provided during the course of a discovery operation in which the speakers in the system transmit configuration information to the renderer 710 including their respective orientations as well as location, type, and other data. Updates may be sent to the renderer through a scheduled polling operation where the renderer polls the speakers for updated information, or through an interrupt-based process in which the speaker sends updated orientation information only after a change in orientation 704. The decoder and renderer then use this updated orientation/configuration orientation to generate and transmit new speaker feeds to the speaker. The renderer can be configured to select multiple possible feeds, which may be a combo of "driver" and "speaker," as previously defined. For example, when vertical, it may select a front firing channel (e.g. Left) and a top firing channel (e.g. Left Top Front). When on its side (horizontal), it may select a single channel, and split driver feeds (e.g., front-facing is full-range, side-firing is low frequency re-enforcement). Although embodiments are described with respect to a speaker orientation that is horizontal or vertical, any other appropriate orientation may also be possible depending on the type and configuration of the speaker. For example, a speaker may be housed or provided on a tilt stand that allows it to be oriented over a range of angles. Any one of the possible tilt angles may be considered a change in orientation depending on the granularity of speaker feed processing options available in the renderer. In another embodiment, a speaker may comprise only front-firing drivers, and tilting the entire cabinet such that the drivers fire upward or downward may cause the renderer to transmit only height or bottom cue reflected audio signals as speaker feeds to the speaker.

Figure 8:
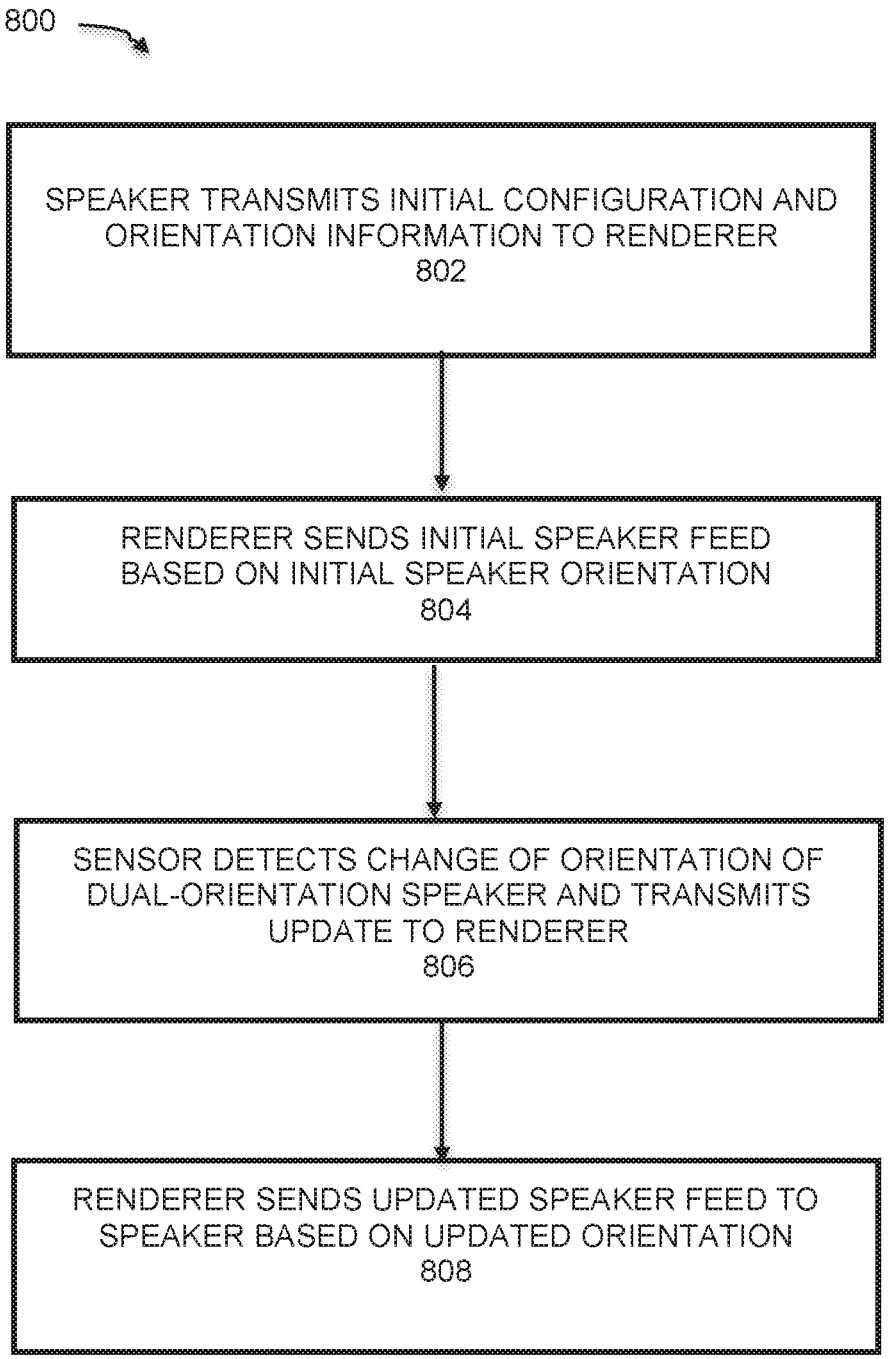
FIG. 8 is a flowchart that illustrates a method of updating speaker feeds for a dual-orientation speaker, under some embodiments.

FIG. 8 is a flowchart that illustrates a method of updating speaker feeds for a dual-orientation speaker, under some embodiments. Once an array of dual orientation speakers has been placed in a room, process 800 begins with one of the speakers being placed in a horizontal orientation to serve as a center channel, or similar speaker function. This constitutes an initial orientation that is transmitted to the renderer, such as in a discovery operation, 802. The renderer sends an initial speaker feed to the speaker based on this orientation, 804. If and when the speaker is moved from the initial orientation to a different (updated) orientation, the sensor in this speaker detects placement in this new orientation and transmits this information to the renderer, 806. The renderer then sends an updated speaker feed to the speaker based on this new orientation. Such an updated speaker feed could be one that effectively cuts out the upward-firing driver if height cues are no longer projected by the speaker.

Embodiments described herein are generally directed to a speaker with a plurality of drivers including one or more angled upward or downward firing drivers for reflected sound rendering. It should be noted that embodiments are not so limited and many different speaker configurations are also possible including fixed and variable angled drivers, tilt-mounted drivers, front/rear, left/right, or up/down projecting drivers, and so on.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," and "hereunder" and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

Various aspects of the present invention may be appreciated from the following enumerated example embodiments (EEEs):

EEE 1. A speaker comprising:
- a cabinet housing a first driver or set of drivers oriented in a first projection direction, and a second driver or set of drivers oriented in a second projection direction;
- a sensor sensing a change in orientation of the cabinet relative to a defined room plane from a first orientation to a second orientation;
- a transmitter sending orientation information of the cabinet to a renderer; and
- a receiver receiving a first speaker feed based on the first orientation of the speaker and a second speaker feed based on the second orientation of the speaker.

EEE 2. The speaker of EEE 1 wherein the speaker feed comprises a plurality of driver feeds each feeding a respective driver of the first and second driver or set of drivers.

EEE 3. The speaker of EEE 1 wherein the second projection direction is one of upward or downward relative to an axis of the first projection direction, and wherein the second projection direction is configured to reflect sound off of one of an upper or lower surface of the room when the cabinet is in the first orientation.

EEE 4. The speaker of EEE 3 wherein the first and second speaker feeds are generated by an immersive audio renderer, and wherein at least a portion of the second speaker feed includes audio signals having height cues.

EEE 5. The speaker of either EEE 3 or 4 wherein the first orientation is vertical and the second orientation is horizontal, and wherein the driver feed for the second set of speakers have zero audio signal when the cabinet is in the second orientation.

EEE 6. A speaker for playing immersive audio content in a room, comprising:
- an enclosure having a vertical axis defining a speaker height and a horizontal axis defining a speaker width;
- an upward-firing driver within the enclosure configured to project sound having height cues to be reflected off of an upper surface of the room;
- a front-firing driver within the enclosure configured to project sound directly into the room;
- a sensor configured to sense an orientation of the enclosure on the floor of the room relative to the vertical axis and the horizontal axis; and
- a transceiver configured to transmit the orientation to a decoder and to receive appropriate speaker feeds from the decoder based on the orientation.

EEE 7. The speaker of any of EEE 6 wherein the transceiver comprises a wireless transceiver.

EEE 8. The speaker of EEE 6 wherein the immersive audio content comprises channel-based audio and object-based audio including sound objects having height components.

EEE 9. The speaker of any of EEEs 6 to 8 wherein the sensor comprises one of: an accelerometer, a gyroscopic component, and a level sensor.

EEE 10. A speaker for playing immersive audio content in a room, comprising:

a rectangular enclosure having a vertical dimension and a horizontal dimension;

a plurality of drivers in the cabinet, including one or more drivers configured to project height cues present in the content;

a sensor configured to sense an orientation of the enclosure on the floor of the room relative to the vertical dimension and the horizontal dimension; and a control circuit configured to modify an audio signal to the drivers based on the orientation of the enclosure.

EEE 11. The speaker of EEE 10 further comprising:

a transmitter configured to transmit the orientation to a renderer; and a receiver configured to receive appropriate speaker feeds from the renderer based on the orientation.

EEE 12. The speaker of EEE 11 wherein the modified audio signal to the drivers comprises the appropriate speaker feeds from the renderer.

EEE 13. The speaker of any of EEEs 10 to 13 wherein the modification comprising cutting respective driver feeds within the speaker feed to the one or more drivers projecting the height cues.

EEE 14. The speaker of any of EEEs 10 to 13 further comprising an upward-firing driver within the enclosure configured to project sound having the height cues to be reflected off of an upper surface of a room when the speaker is in a vertical orientation; and one or more front-firing driver within the enclosure configured to project sound directly into the room.

EEE 15. A system for rendering immersive audio content including reflected sound elements, comprising:

a plurality of speakers, each speaker comprising an enclosure housing an upward-firing driver and a front-firing driver and configured to detect a change in orientation between a vertical orientation and a horizontal orientation of the enclosure, and to change selected output feeds to one or more of the drivers depending on orientation; and a renderer configured to transmit individual speaker feeds to each speaker of the plurality of speakers based on their respective locations and orientations in the room.

EEE 16. The system of EEE 15 wherein each speaker is configured to transmit its respective orientation information to the renderer and receive updated speaker feeds in response to the respective orientation.

EEE 17. The system of EEE 16 wherein the speaker placed in the horizontal orientation operates as a front central speaker, and the respective locations of the remaining plurality of speakers conform to a defined speaker layout.

EEE 18. The system of EEE 17 wherein the defined speaker array configuration comprises a surround sound configuration.

EEE 19. The system of any of EEEs 15 to 18 wherein the renderer and each of the plurality of speakers are coupled over a wireless network that transmits each speaker's respective orientation and location information, and the speaker feeds from the renderer to the speakers.

EEE 20. The system of any of EEEs 15 to 19 wherein the immersive audio content comprises channel-based audio and object-based audio including sound objects having height cues.

EEE 21. The system of EEE 20 wherein the height cues are played back by one or more of the respective upward-firing drivers of the plurality of speakers projecting sound to an upper surface of the room to be reflected down into the room.

EEE 22. The system of EEE 21 wherein the renderer separately generates direct signal components for playback through the front-firing driver and the height cue signals for playback through the upward-firing driver of each speaker.

EEE 23. A method for rendering immersive audio content comprising:

sending first orientation information from a speaker having a cabinet housing a first driver or set of drivers oriented in a first projection direction, and a second driver or set of drivers oriented in a second projection direction;

detecting a change in orientation of the cabinet relative to a defined room plane from a first orientation to a second orientation;

transmitting orientation information of the cabinet to a renderer; and receiving a first speaker feed based on the first orientation of the speaker and a second speaker feed based on the second orientation of the speaker.

EEE 24. The method of EEE 1 wherein the first orientation information is obtained in the renderer from a speaker discovery process.

EEE 25. The method of EEE 25 wherein the second orientation information is obtained in the renderer through an update transmission from the speaker in response to a change from the first orientation to the second orientation.

EEE 26. The method of EEE 1 wherein the first orientation is one of horizontal or vertical, and the second orientation is opposite the first orientation and is one of vertical or horizontal.

EEE 27. A method for rendering sound using reflected sound elements, comprising:

detecting placement of a speaker in an array of like speakers in a horizontal orientation relative to the remaining speakers in the array, each speaker comprising a plurality of drivers including an upward-firing driver and a front-firing driver in an enclosure;

modifying selected output feeds to one or more of the drivers of the speaker in the horizontal orientation;

transmitting from a renderer, individual speaker feeds to each speaker based on a respective orientation relative to the speaker in the horizontal orientation.

EEE 28. The method of EEE 27 wherein the modifying comprises receiving updated speaker feeds from the renderer based on the change of the speaker to the horizontal orientation.

EEE 29. The method of EEE 28 wherein the front-firing driver transmits sound waves parallel to a ground plane, and the upward-firing driver is oriented at an inclination angle relative to the ground plane and is configured to reflect sound off an upper surface of a listening environment to produce a reflected speaker location.

What is claimed is:

1. A system comprising:

at least one speaker comprising:

a cabinet housing at least one upward-firing driver and at least one front-firing driver, wherein, in a vertical orientation of the cabinet, the at least one upward-firing driver is positioned above the at least one front-firing driver;

a sensor configured to sense whether the cabinet is in the vertical orientation or in a horizontal orientation;

a transmitter for sending information to a renderer; and a receiver for receiving a speaker feed; and a renderer external to the at least one speaker, the renderer comprising:

a receiver for receiving information from the at least one speaker; and a transmitter configured to transmit individual speaker feeds to each speaker, wherein each speaker feed includes at least one of a first driver feed for at least one upward-firing driver and a second driver feed for at least one front-firing driver, wherein the transmitter of the at least one speaker is configured to send information indicative of the cabinet's orientation sensed by the sensor to the renderer, and the receiver of the renderer is configured to receive said information, the renderer being configured to transmit a first speaker feed to the at least one speaker when the received orientation information indicates that said speaker is in the horizontal orientation and to transmit a second speaker feed to the at least one speaker, different from the first speaker feed, when the received orientation information indicates that said speaker is in the vertical orientation, and further wherein the at least one speaker comprises a processing component configured to apply a height cue filter to an audio signal for the upward-firing driver included in the second speaker feed if the cabinet is in the vertical orientation and to apply a different filter or no filter to an audio signal for the upward-firing driver included in the first speaker feed if the cabinet is in the horizontal orientation.

2. The system of claim 1, wherein the first driver feed of the first speaker feed is different from the first driver feed of the second speaker feed.

3. The system of claim 2, wherein the first driver feed of the first speaker feed has zero audio signal.

4. The system of claim 1, wherein the second speaker feed includes a first driver feed for driving the upward-firing driver, while the first speaker feed does not include a first driver feed for driving the upward-firing driver.

5. The system of claim 1, wherein the first speaker feed includes a first driver feed for driving the upward-firing driver as a side-firing driver, while the second speaker feed includes a first driver feed for driving the upward-firing driver as an upward-firing driver.

6. The system of claim 1, the wherein each receiver and transmitter respectively comprises a wireless receiver and transmitter and the renderer is configured to wirelessly receive and transmit the information and the first and second speaker feeds to the at least one speaker.

7. The system of claim 1, wherein the renderer is configured to transmit individual speaker feeds to the at least one speaker based on its respective location and orientation.

8. The system of claim 1, wherein a first speaker is placed in the horizontal orientation and a plurality of other speakers are placed in the vertical orientation, wherein the respective locations of the speakers conform to a surround sound configuration, wherein the system is configured to operate the first speaker as a front central speaker.

9. The system of claim 6, wherein the renderer and the at least one speaker are coupled over a wireless network that transmits each speaker's respective orientation and location information, and the speaker feeds from the renderer to the at least one speaker.

10. The system of claim 1, wherein the system is suitable for rendering immersive audio content comprising channel-based audio and object-based audio including sound objects having height cues, wherein one or more of the respective upward-firing drivers of the at least one speaker are configured to play back the height cues, wherein the renderer is configured to separately generate direct signal components for playback through the front-firing driver and the height cue signals for playback through the upward-firing driver of each speaker.

11. A speaker comprising:

a cabinet housing at least one upward-firing driver and at least one front-firing driver, wherein, in a vertical orientation of the cabinet, the at least one upward-firing driver is positioned above the at least one front-firing driver;

a sensor configured to sense whether the cabinet is in the vertical orientation or in a horizontal orientation;

a transmitter configured to send information indicative of the cabinet's orientation sensed by the sensor to an external renderer;

a receiver for receiving from the external renderer a first speaker feed when the cabinet is in the horizontal orientation and a second speaker feed, different from the first speaker feed, when the cabinet is in the vertical orientation; and a processing component configured to apply a height cue filter to an audio signal for the upward-firing driver included in the second speaker feed if the cabinet is in the vertical orientation and to apply a different filter or no filter to an audio signal for the upward-firing driver included in the first speaker feed if the cabinet is in the horizontal orientation.

12. The speaker of claim 11 further comprising an interface for connection to a renderer, the renderer comprising:

a receiver configured to receive from one or more speakers, orientation information indicative of whether the corresponding speaker is in a vertical orientation or in a horizontal orientation, a transmitter configured to transmit individual speaker feeds to each speaker, wherein each speaker feed includes at least one of a first driver feed for at least one upward-firing driver and a second driver feed for at least one front-firing driver, wherein the renderer is configured to transmit a first speaker feed to a corresponding speaker when the received orientation information indicates that said speaker is in the horizontal orientation and to transmit a second speaker feed, different from the first speaker feed, when the received orientation information indicates that said speaker is in the vertical orientation.

13. A method for rendering immersive audio content in a system comprising a renderer and at least one speaker comprising at least one upward-firing driver and at least one front-firing driver, the method comprising:

detecting, by the speaker, whether the speaker is in a vertical orientation or a horizontal orientation;

transmitting, by the speaker, orientation information indicative of the detected orientation of the speaker to the renderer;

receiving, by the renderer, the orientation information sent by the speaker;

sending, by the renderer, a first speaker feed when the orientation information indicates that the speaker is in the horizontal orientation, and sending, by the renderer, a second speaker feed, different from the first speaker feed, when the orientation information indicates that the speaker is in the vertical orientation, wherein each speaker feed includes at least one of a first driver feed for the at least one upward-firing driver and a second driver feed for the at least one front-firing driver;

applying, by the speaker, a height cue filter to an audio signal included in the first driver feed of the second speaker feed if the cabinet is in the vertical orientation and to apply a different filter or no filter to an audio signal included in the first driver feed of the first speaker feed if the cabinet is in the horizontal orientation;

receiving, by the speaker, the first speaker feed or the second speaker feed respectively; and driving the speaker according to the received first or second speaker feed.

14. The method of claim 13, further comprising:

performing the transmitting, receiving, and sending wirelessly through respective wireless receivers and transmitters in the speaker and the renderer.

15. The method of claim 13, wherein the first driver feed of the first speaker feed is different from the first driver feed of the second speaker feed, wherein preferably the first driver feed of the first speaker feed has zero audio signal.

* * * * *